US009531124B2

(12) United States Patent
Ohler

(10) Patent No.: US 9,531,124 B2
(45) Date of Patent: Dec. 27, 2016

(54) ELECTRICAL PLUG REMOVAL DEVICE

(71) Applicant: Leo Ohler, Lahaina, HI (US)

(72) Inventor: Leo Ohler, Lahaina, HI (US)

( * ) Notice: Subject to any disclaimer, the term of this patent is extended or adjusted under 35 U.S.C. 154(b) by 0 days.

(21) Appl. No.: 14/883,024

(22) Filed: Oct. 14, 2015

(65) Prior Publication Data

US 2016/0036162 A1 Feb. 4, 2016

Related U.S. Application Data

(60) Provisional application No. 62/089,899, filed on Dec. 10, 2014.

(51) Int. Cl.

| | |
|---|---|
| ***H01R 4/66*** | (2006.01) |
| ***H01R 13/633*** | (2006.01) |
| *H01R 13/713* | (2006.01) |
| *H01R 25/00* | (2006.01) |

(52) U.S. Cl.

CPC ..... *H01R 13/633* (2013.01); *H01R 13/7132* (2013.01); *H01R 25/003* (2013.01)

(58) Field of Classification Search

CPC ..... H01R 27/00; H01R 13/652; H01R 29/00; H01R 23/025; H01R 25/006; H02G 3/18

USPC ..... 439/103, 106, 107, 218, 221, 222, 224,439/535, 536; 174/53

See application file for complete search history.

(56) References Cited

U.S. PATENT DOCUMENTS

| | | | | |
|---|---|---|---|---|
| 2,400,351 A * | 5/1946 | Hart | H01M 2/1055 | 174/75 C |
| 4,045,106 A | 8/1977 | Borg | | |
| 4,114,969 A | 9/1978 | Borg | | |
| 4,140,358 A * | 2/1979 | Marechal | H01R 13/447 | 439/135 |
| 4,445,743 A * | 5/1984 | Bakker | H01R 13/625 | 439/289 |
| 4,767,181 A * | 8/1988 | McEowen | G02B 6/3817 | 385/60 |
| 4,954,091 A * | 9/1990 | Marble | H01R 13/652 | 439/103 |
| 5,171,291 A | 12/1992 | d'Alayer de Costemore d'Arc et al. | | |
| 5,266,040 A | 11/1993 | Merrill et al. | | |
| 5,480,313 A | 1/1996 | d'Alayer de Costemore d'Arc | | |
| 5,622,509 A * | 4/1997 | Smythe | H01R 13/652 | 439/103 |
| 5,641,292 A * | 6/1997 | Fann | H01R 13/652 | 439/103 |
| 5,921,783 A * | 7/1999 | Fritsch | H01R 13/44 | 439/38 |

(Continued)

*Primary Examiner* — Thanh Tam Le

(74) *Attorney, Agent, or Firm* — Global Intellectual Property Agency, LLC; Daniel Boudwin

(57) ABSTRACT

An electrical socket having an electrical plug removal device for allowing a user to more easily remove an electrical plug from an electrical socket. The electrical socket resembles a traditional electrical socket having openings into which the prongs of an electrical plug can be inserted. A switch is provided adjacent to the electrical socket, wherein the switch can be actuated in order to release the electrical plug from the electrical socket. In a preferred embodiment, the switch is operably connected to an ejecting device that includes one or more levers positioned within the openings of the electrical socket, wherein the levers are adapted to press against the prongs in order to eject the electrical plug from the socket. The levers can be electrically or mechanically operated depending upon the embodiment.

6 Claims, 2 Drawing Sheets

(56) References Cited

U.S. PATENT DOCUMENTS

| | | | | |
|---|---|---|---|---|
| 5,940,015 | A * | 8/1999 | Thornton | H01H 13/702 200/302.2 |
| 6,227,883 | B1 * | 5/2001 | Lee | H01R 13/652 439/106 |
| 6,419,504 | B1 * | 7/2002 | Nelson | H01R 13/652 439/103 |
| 7,192,303 | B2 * | 3/2007 | Kohen | F21V 21/03 439/135 |
| 7,311,526 | B2 * | 12/2007 | Rohrbach | H01R 13/6205 439/218 |
| 7,513,782 | B1 * | 4/2009 | Sheldon | H01R 13/652 439/106 |
| 7,625,230 | B2 | 12/2009 | Boerner | |
| 8,894,436 | B2 * | 11/2014 | Su | H01R 12/7088 439/501 |

* cited by examiner

ELECTRICAL PLUG REMOVAL DEVICE

CROSS REFERENCE TO RELATED APPLICATION

This application claims the benefit of U.S. Provisional Application No. 62/089,899 filed on Dec. 10, 2014. The above identified patent application is herein incorporated by reference in its entirety to provide continuity of disclosure.

BACKGROUND OF THE INVENTION

Field of the Invention

The present invention relates to electrical sockets. More specifically, the present invention provides an electrical socket having an electrical plug removal device. The electric socket comprises an ejecting device positioned within the openings of the socket, wherein the ejecting device is adapted to eject the prongs of an electrical plug from the socket so as to facilitate removal of the electrical plug.

It is often difficult to remove an electrical plug from an electrical socket, such as an electrical socket located on a wall or a power strip. The electrical plug must be pulled with a considerable amout of force in order to remove the electrical plug from the socket. Further, it is sometimes necessary to wiggle the plug in order to loosen the prongs of the electrical plug from the socket in order to free the same. For electrical plugs inserted into electrical sockets on power strips, the user must hold or stabilize the power strip while simultaneously pulling the electrical plug in order to remove the plug therefrom.

Removing an electrical plug from an electrical socket can be difficult, particularly for those with limited hand dexterity or hand strength. This is especially true for the elderly and for people suffering from arthritis or similar ailments. As a result, some people struggle to withdraw an electrical plug from an electrical socket. Further, pulling on the cable that is attached to the electrical plug can cause structural damage to the cable, such as fraying of the cable, or may bend or damage the prongs. As a result, an electrical socket having means for facilitating removal of an electrical plug therefrom is desired.

Devices have been disclosed in the prior art that relate to electrical plug releasing devices. These include devices that have been patented and published in patent application publications. These devices generally relate to electrical plug removal devices having various means for releasing the electrical plug, such as spring-loaded components, such as U.S. Pat. No. 4,045,106, U.S. Pat. No. 4,114,969, U.S. Pat. No. 5,171,291, U.S. Pat. No. 5,266,040, and U.S. Pat. No. 7,625,230.

These prior art devices have several known drawbacks. The devices in the prior art provide electrical plug releasing devices having various means for releasing electrical plugs. However, such devices fail to include an electrical socket having an ejecting device within the openings of the electrical socket that serve to release the electrical plug from the electrical socket. Further, such devices lack an ejecting device having levers within the electrical socket that force the prongs of an electrical plug from the openings of the electrical socket.

In light of the devices disclosed in the prior art, it is submitted that the present invention substantially diverges in design elements from the prior art and consequently it is clear that there is a need in the art for an improvement to existing electrical plug removal devices. In this regard the instant invention substantially fulfills these needs.

SUMMARY OF THE INVENTION

In view of the foregoing disadvantages inherent in the known types of electrical plug removal devices now present in the prior art, the present invention provides a new electrical plug removal device wherein the same can be utilized for providing convenience for the user when removing an electrical plug from an electrical socket.

It is therefore an object of the present invention to provide a new and improved electrical plug removal device comprising an electrical socket having an ejecting device adapted to release an electrical plug from the electrical socket.

It is another object of the present invention to provide an electrical plug removal device comprising an ejecting device having one or more levers positioned within the openings of the electrical socket, wherein the levers are adapted to move within the openings in order to push or eject the prongs of an electrical plug from the electrical socket.

Another object of the present invention is to provide an electrical plug removal device that resembles a traditional electrical socket.

Yet another object of the present invention is to provide an electrical plug removal device that is mechanically or electronically operated.

Another object of the present invention is to provide an electrical plug removal device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
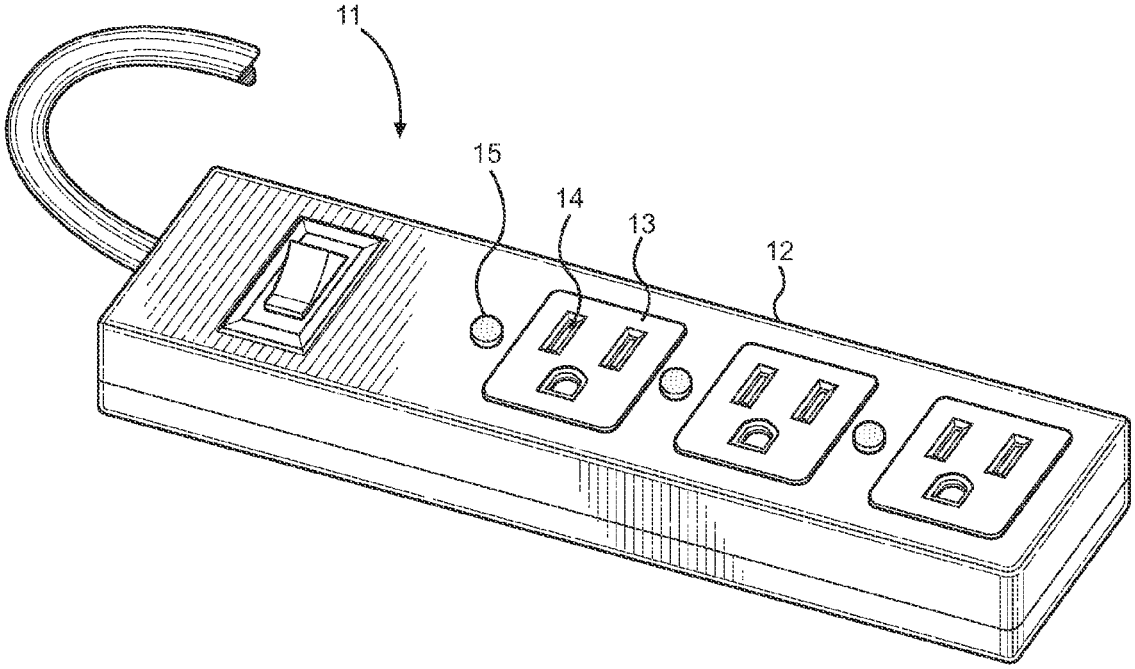
FIG. 1 shows a perspective view of an embodiment of the electrical plug removal device.

Reference is made herein to the attached drawings. Like reference numerals are used throughout the drawings to depict like or similar elements of the electrical plug removal device. For the purposes of presenting a brief and clear description of the present invention, the preferred embodiment will be discussed as used for facilitating removal of an electrical plug from an electrical socket. The figures are intended for representative purposes only and should not be considered to be limiting in any respect.

Referring now to FIG. 1, there is shown a perspective view of an embodiment of the electrical plug removal device. The electrical plug removal device 11 comprises at least one electrical socket 13 having a plurality of openings 14 adapted to receive the prongs of an electrical plug therein.

The openings 14 can be arranged in any configuration so as to receive different types of electrical plugs, such as electrical plugs of the type commonly used in America, Europe, or Australia, among others. The electrical sockets 13 can be arranged on a housing 12 in various configurations so as to resemble a conventional power strip having a plurality of sockets 13 for receiving electrical plugs from various devices.

Each electrical socket 13 comprises an ejecting device therein, wherein the ejecting device is operably controlled via a switch 15. The switch 15 is preferably located adjacent to the electrical socket 13 on the housing. The switch 15 can be any of various types of switches or controls, such as a push-button or a rocker switch, among others. With an electrical plug inserted into an electrical socket 13 of the present invention, the switch 15 can be operated in order to forcibly eject the electrical plug from the electrical socket 13.

Figure 2:
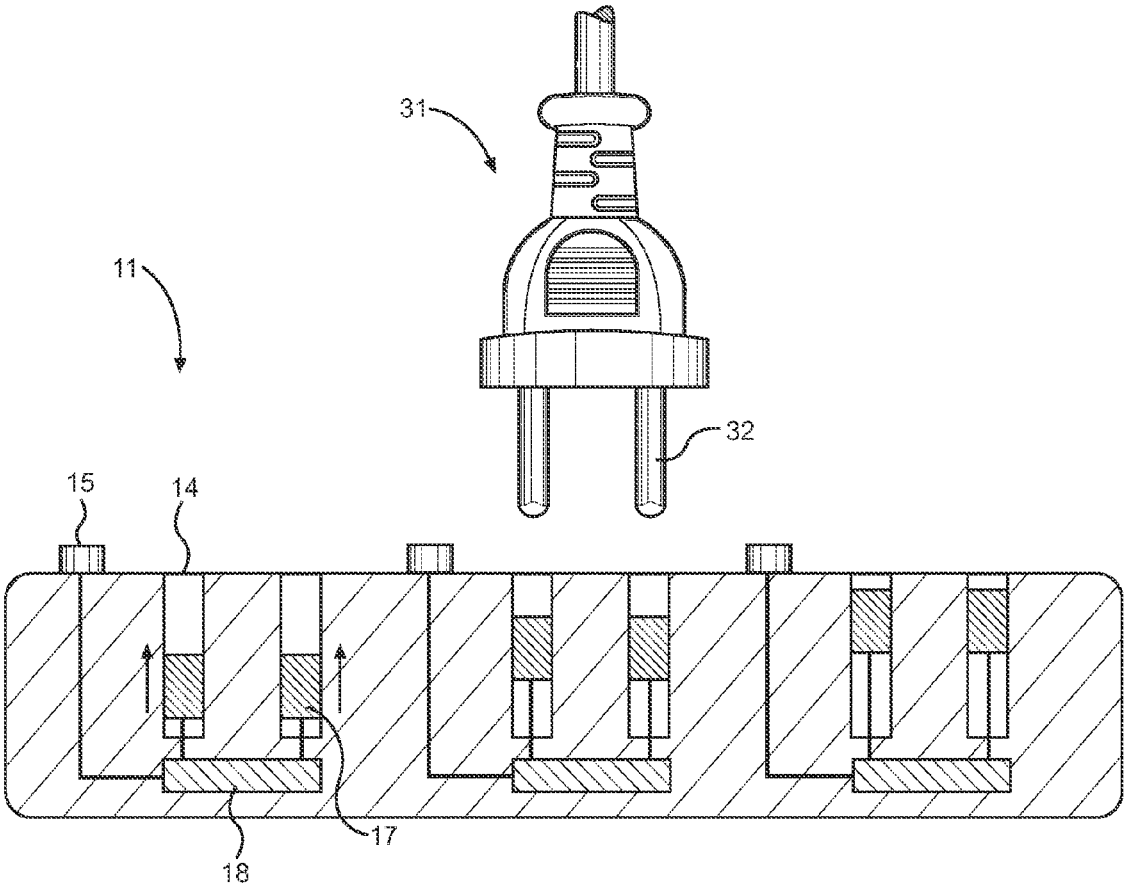
FIG. 2 shows a cross sectional view of the electrical plug removal device.

Referring now to FIG. 2, there is shown a cross sectional view of the electrical plug removal device. The electrical plug removal device 11 is adapted to force the prongs 32 of an electrical plug 31 from the openings 14 of the electrical socket in order to eliminate the need for the user to pull the electrical plug 31 from the electrical socket. The electrical plug removal device 11 comprises an ejecting device position within the openings 14 of the electrical socket. The ejecting device is adapted to push the prongs 32 of the electrical plug 31 upward and out from the openings 14 of the electrical socket.

In the illustrated embodiment, the ejecting device comprises one or more levers 17, wherein each opening 14 on the socket includes a lever 17 therein that is adapted to move from a resting position to an extended position. In the resting position, the electrical plug 31 can be fully inserted into the openings 14 of the electrical socket so as to function in the conventional manner. In the extended position, the levers 17 extend upward towards the upper end of the opening 14 in order to push the prong 32 upward and out of the electrical socket. The levers 17 are preferably composed of a non-conducting material, such as a plastic material, so as to not conduct electricity from the electrical plug or interfere with the operation of the electrical plug.

The levers 17 are automatically controlled via a motor 18 or other similar actuator. In operation, when a user operates the switch 15, the motor 18 causes the levers 17 to move from the resting position to the extended position so as to force the prongs 32 from the electrical socket 13. The levers 17 are adapted to automatically return to the resting position after reaching the extended configuration so that an electrical plug 31 can again be inserted into the electrical socket. Any suitable means may be used for causing the levers 17 to move into an extended configuration.

In alternate embodiments, the levers 17 may be mechanically moved between the resting and extended positions. In such embodiments, a pivoting arm is movably connected to the switch 15 and to the levers 17. When the switch 15 is actuated, the pivoting arm causes the levers 17 to move into an extended position. The levers 17 are adapted to return to a resting position once the levers 17 have moved to the extended configuration.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical plug removal device, comprising:

an electrical socket having openings adapted to removably receive an electrical plug having prongs therein;

an ejecting device having levers, each lever positioned within each opening and adapted to forcibly eject each prong from said electrical socket.

2. The electrical plug removal device of claim 1, wherein said electrical socket comprises three openings.

3. The electrical plug removal device of claim 1, further comprising a switch adapted to operate said ejecting device.

4. The electrical plug removal device of claim 1, wherein said ejecting device comprises a motor adapted to control operation of said levers.

5. The electrical plug removal device of claim 1, wherein said levers are movable between a resting position in which an electrical plug can be fully inserted into said electrical socket, and an extended position in which said levers move upward towards an upper end of said openings.

6. The electrical plug removal device of claim 5, further comprising a motor adapted to move said levers between said resting position and said extended position.

* * * * *